US005988098A

United States Patent [19]

Hillhouse

[11] Patent Number: 5,988,098

[45] Date of Patent: Nov. 23, 1999

[54] KAYAKING HARNESS

[76] Inventor: Kevin E. Hillhouse, HHC 22nd Sig BN, CMR 431 Box 1608, APO AE 09175-1608

[21] Appl. No.: 09/234,640

[22] Filed: Jan. 21, 1999

[51] Int. Cl.[6] ..... B63B 35/00

[52] U.S. Cl. ..... 114/347

[58] Field of Search ..... 297/484; 182/3; 114/347, 343, 364; 441/80, 84

[56] References Cited

U.S. PATENT DOCUMENTS

| | | | |
|---|---|---|---|
| D. 290,293 | 6/1987 | Hambley . | |
| 293,799 | 2/1884 | Simkin . | |
| 604,677 | 5/1898 | Humphrey . | |
| 638,861 | 12/1899 | Bean . | |
| 2,441,115 | 5/1948 | Lambert . | |
| 3,125,375 | 3/1964 | Bird et al. . | |
| 3,990,743 | 11/1976 | Nelson . | |
| 5,159,044 | 10/1992 | Wydra | 182/3 |
| 5,215,239 | 6/1993 | Walters, Jr. . | |
| 5,367,975 | 11/1994 | Hamilton et al. | 114/347 |
| 5,511,507 | 4/1996 | Allen | 114/347 |
| 5,544,363 | 8/1996 | McCue et al. . | |
| 5,664,844 | 9/1997 | Greene | 297/484 |
| 5,676,426 | 10/1997 | Herring | 297/484 |

FOREIGN PATENT DOCUMENTS

| | | |
|---|---|---|
| 72350 | 4/1951 | Denmark . |
| 79436 | 11/1951 | Norway . |
| 969687 | 6/1962 | United Kingdom . |

*Primary Examiner*—Stephen Avila
*Attorney, Agent, or Firm*—Richard C. Litman

[57] ABSTRACT

The kayaking harness provides a kayaker with support for his back during extended boating sessions. The harness has a back support structure and a tether for attaching the back support structure to the kayak. The back support structure has a torso band having a first end and a second end, the torso band encircling the trunk of the body, a pair of shoulders straps, each shoulder strap having a first end attached to the torso band and a free second end, and a support band attached between the shoulder straps parallel to the torso band. The tether has a loop at one end, the two ends of the torso band and the free ends of the shoulder straps being attached to the loop, and an attachment mechanism at the other end for attaching the tether to the kayak, at least part of the tether having an elastic strap in parallel with nylon webbing so that the tether is resilient and extensible to the length of the webbing.

7 Claims, 4 Drawing Sheets

KAYAKING HARNESS

BACKGROUND OF THE INVENTION

1. Field of the Invention

The present invention relates to accessories for sporting and boating, and particularly to a kayaking harness for supporting the back of the kayaker on extended kayaking trips such as expeditions and touring.

2. Description of the Related Art

Kayaking is a popular boating sport throughout the world Although kayaks may be broadly classified as touring kayaks (designed for stability and boating on extended bodies of water such as lakes, seas, etc.) or as whitewater kayaks (designed for maneuverability and boating on rivers, streams, etc.), the kayak enthusiast may have occasion to spend hours at a time in the cockpit of his craft while engaged in touring on extended trips over large bodies of water, or in whitewater expeditions on long and winding rivers.

On such occasions, the kayaker's back may tend to become tired or sore. The back rest in the cockpit of a conventional kayak is extremely short, extending no further than the small of the back. Consequently, kayakers must rely upon their back muscles to maintain an erect sitting posture while holding and using a twin blade paddle to stroke on both sides of the kayak. After several hours of sitting in essentially the same posture with no support for the middle and upper back, the kayaker's back muscles can become exhausted and weaken.

The present invention is a back harness especially designed for use with kayaks which allows the kayaker to lean back and support the weight of his upper torso with the harness, relieving tension in the back muscles.

U.S. Pat. No. 3,990,743, issued Nov. 9, 1976 to H. W. Nelson, describes a back support for canoes having a rigid seat. However, this device is not a harness, but an elongated back support supported by a strut attached to the front end of the seat and a brace under the seat. The device is not suited to use in a kayak, as the support would interfere with the nylon or tubular neoprene spray skirts used to protect the cockpit from water.

U.S. Des. Pat. No. 290,293, issued Jun. 9, 1987 to W. D. Hambley, shows what appears to be a loop which may be fitted around the torso having a semicircle of fabric attached to a semicircle of rigid tubing. Three parallel springs extend from the tubing, and are attached at their free end to a small rod having a hook.

The drawings in Norwegian patent No. 79436, published Nov. 26, 1951, appear to show a harness which appears to be a single piece of elongated webbing having its ends joined behind the waist and looping through a ring in front of the waist three times in order to wind around the waist, the ribs, and the shoulders, criss crossing in the back posterior to the chest. A ring encircles the webbing on either side of the waist, straps being attached to the ring for connection to another apparatus.

The drawings in Danish patent 72350, published Apr. 2, 1951 show a band having a buckle fastening its ends to form a loop for encircling the torso. A pair of shoulder straps, which do not appear to be adjustable in length, criss cross at the back of the loop and are fixedly attached to the band. A pair of loops encircled by rings are attached to the back of the band. Snap hooks attach two smaller loops to the rings.

Additional harnesses and safety belts adapted for other applications include: U.S. Pat. No. 293,799, issued Feb. 19, 1884 to G. B. Simkin (safety belt for window washers and painters); U.S. Pat. No. 604,677, issued May 24, 1898 to W. C. Humphrey (brace and back support for bicyclist); U.S. Pat. No. 638,861, issued Dec. 12, 1899 to L. C. Bean (harness for bicyclist); U.S. Pat. No. 2,441,115, issued May 4, 1948 to W. Lambert (shoulder harness supporting a pail, used by fruit and vegetable pickers); U.S. Pat. No. 3,125,375, issued Mar. 17, 1964 to G. L. Bird, et al. (safety harness for a child seated on car seat); U.S. Pat. No. 5,215,239, issued Jun. 1, 1993 to P. A. Walters, Jr. (harness for supporting a musical instrument, such a a saxophone); U.S. Pat. No. 5,544,363, issued Aug. 13, 1996 to McCue, et al. (vest and harness for ambulance attendants); and U.K. Patent No. 969,687, published Jun 8, 1962 (harness with a seat sling for supporting workers at a height above ground level).

None of the above inventions and patents, taken either singularly or in combination, is seen to describe the instant invention as claimed. Thus a kayaking harness solving the aforementioned problems is desired.

SUMMARY OF THE INVENTION

The kayaking harness provides a kayaker with support for his back during extended boating sessions. The harness has a back support structure and a tether for attaching the back support structure to the kayak. The back support structure has a torso band having a first end and a second end, the torso band encircling the trunk of the body, a pair of shoulders straps, each shoulder strap having a first end attached to the torso band and a free second end, and a support band attached between the shoulder straps parallel to the torso band. The tether has a loop at one end, the two ends of the torso band and the free ends of the shoulder straps being attached to the loop, and an attachment mechanism at the other end for attaching the tether to the kayak, at least part of the tether having an elastic strap in parallel with nylon webbing so that the tether is resilient and extensible to the length of the webbing.

The attachment mechanism preferably includes a quick release mechanism for detaching the harness from the kayak quickly in an emergency. The torso band and shoulder straps are adjustable in length. Preferably, one side of the back support structure includes quick release buckles for quickly unhooking the harness.

Accordingly, it is a principal object of the invention to relieve strain on the back muscles during extended periods of kayaking by providing a kayaking harness for supporting the kayaker's back.

It is another object of the invention to provide a kayaking harness for supporting the back of the kayaker which includes a mechanism for attachment to the kayak which is quickly detachable in an emergency.

It is a further object of the invention to provide a kayaking harness which is adaptable to different makes and models of kayaks by providing a tether for attaching the harness to the kayak which is elastic.

Still another object of the invention is to provide a kayaking harness to relieve the postural strain on the kayaker's back during touring and expeditions which is safe, economical, and compatible with both touring and whitewater kayaks.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

Figure 1:
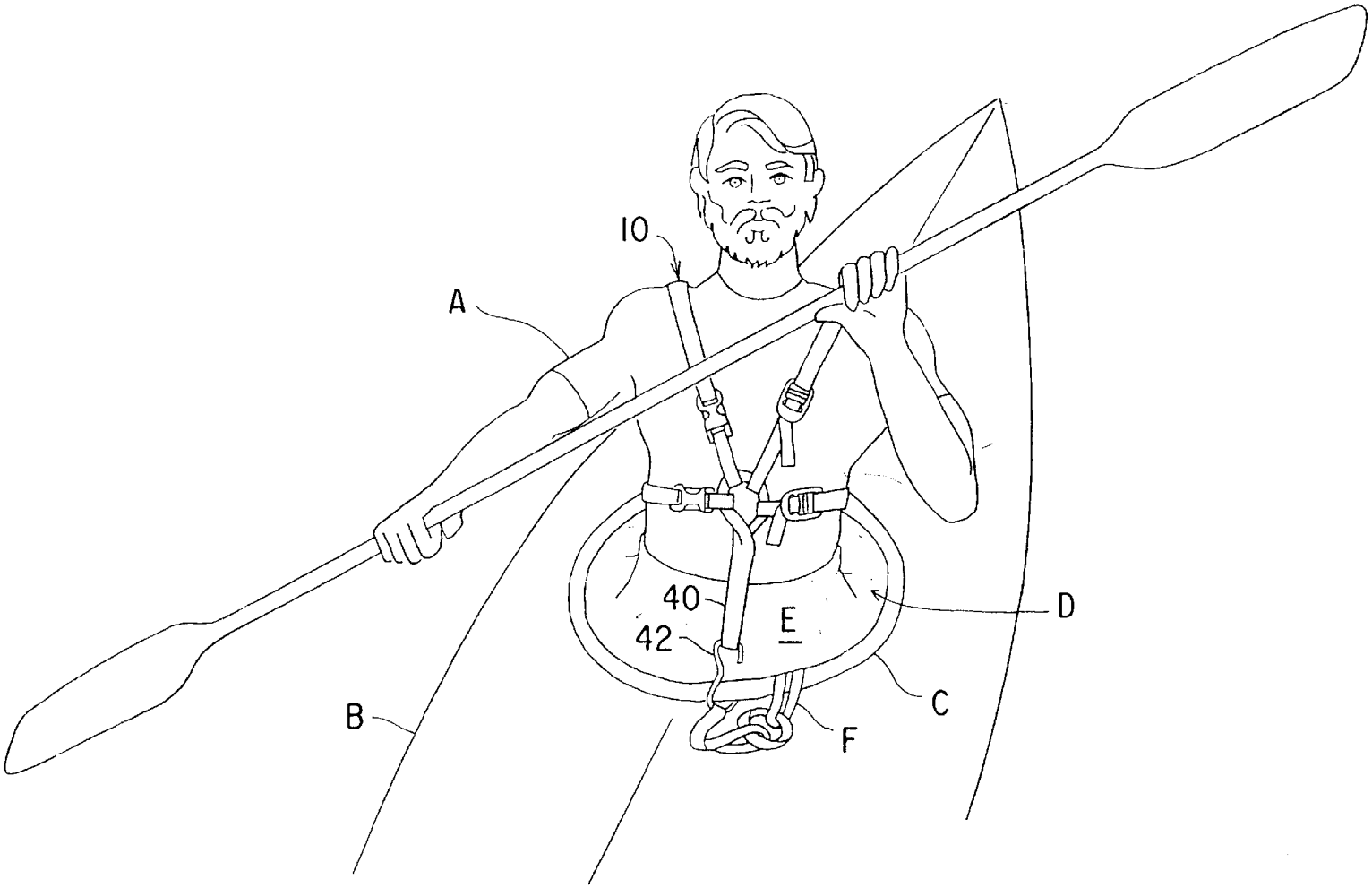
FIG. 1 is an environmental, perspective view of a kayaking harness according to the present invention.
Figure 2:
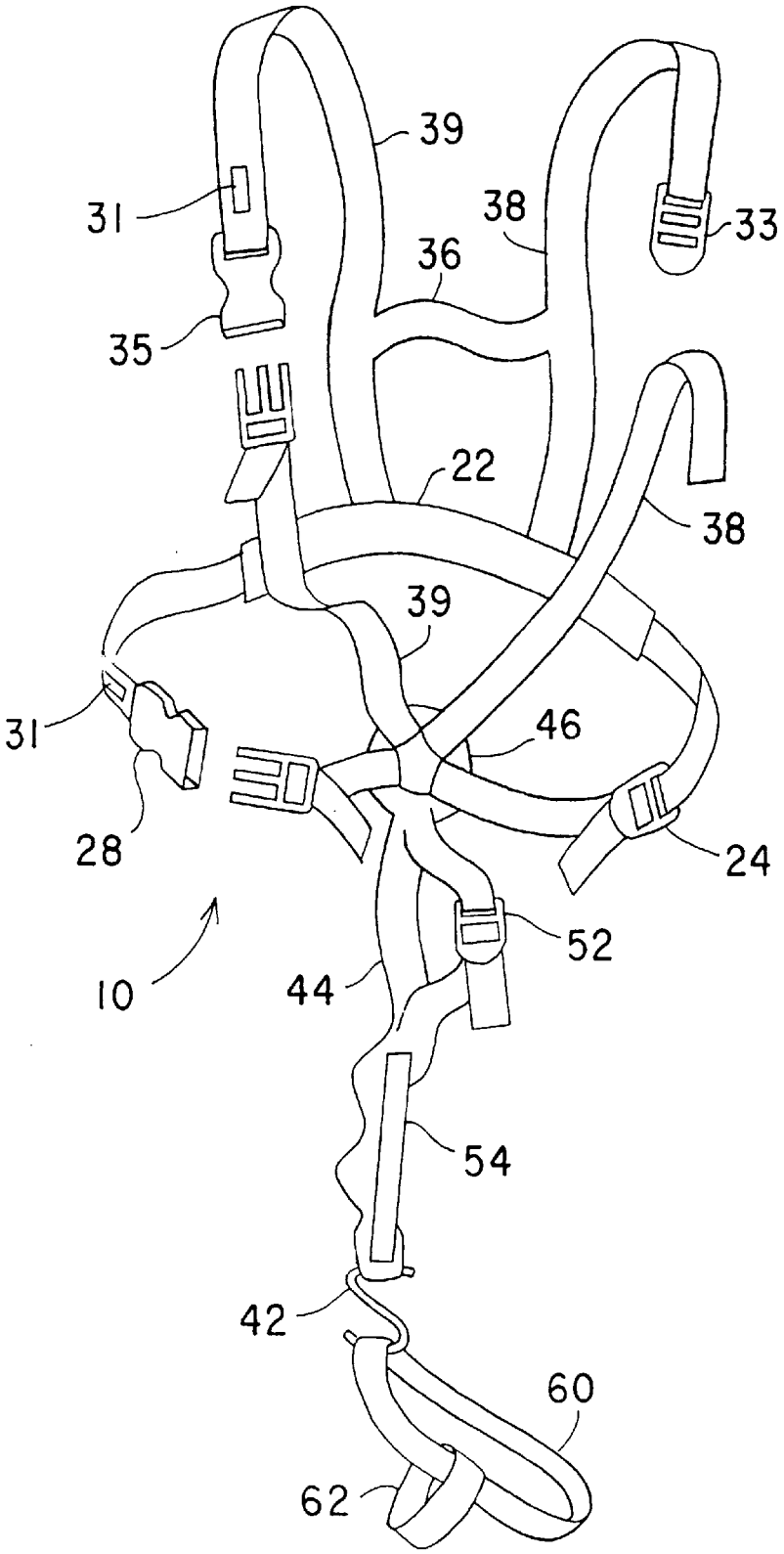
FIG. 2 is a perspective view of a kayaking harness according to the present invention.
Figure 3:
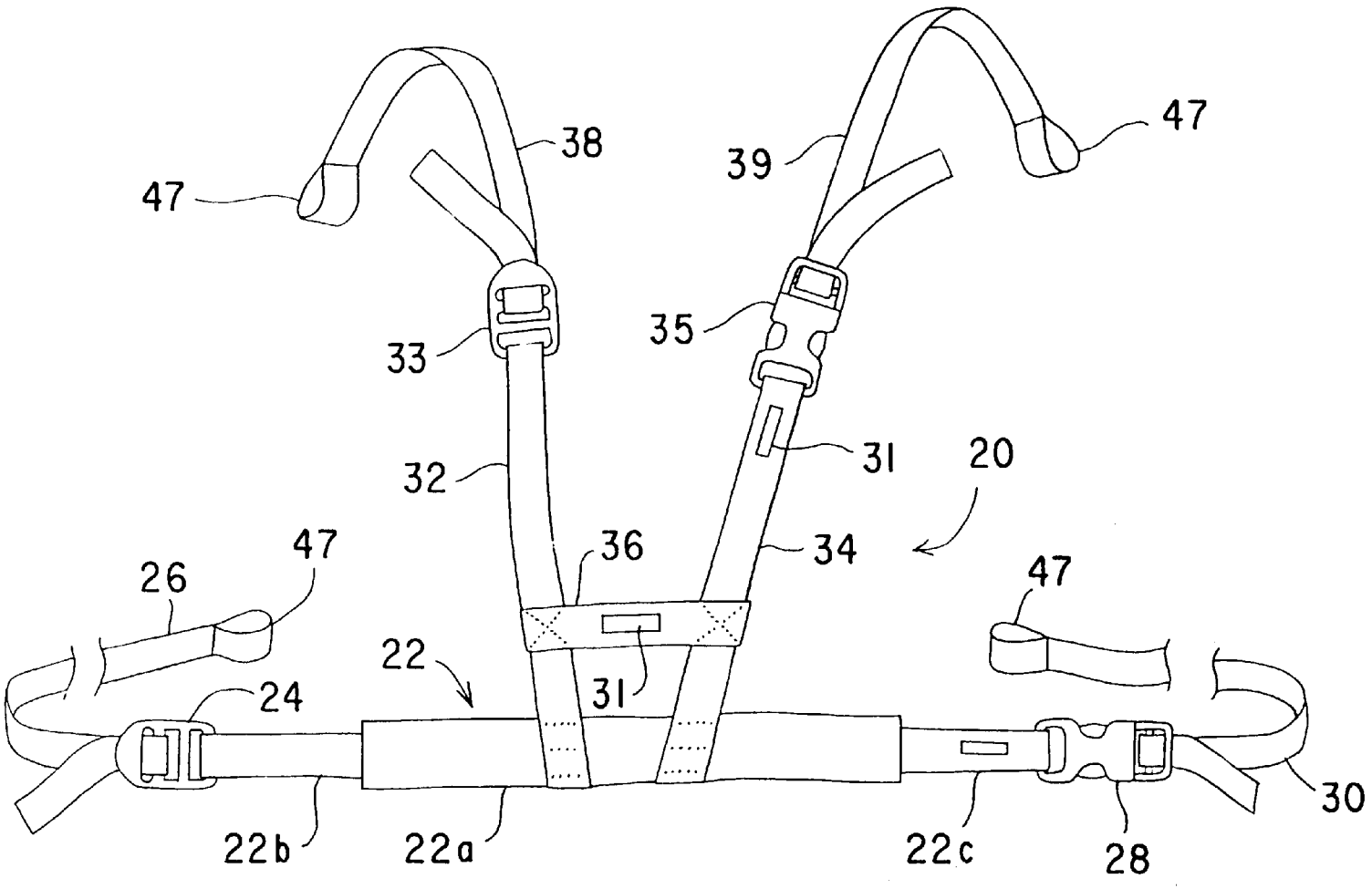
FIG. 3 is a rear view of the back support of the kayaking harness according to the present invention.

The present invention is a kayaking harness, designated generally as 10 in the drawings, which provides back support for the kayaker during touring and expeditions. As shown in FIG. 1, the harness 10 is worn about the upper torso of the kayaker A and is removably connected to the kayak B by a hook 42 which attaches to the coaming C around the cockpit D of the kayak B. The kayaker A will normally sit in the cockpit D which is covered by a spray skirt E made of nylon or neoprene. The spray skirt E fits around the waist of the kayaker A and is attached to the kayak A by an elastic cord sewn into the hem of the skirt E which is pressed over a lip or coaming C around the cockpit D. The skirt E has a grab loop F which the kayaker A can use during a so-called water exit for quick release when the boat capsizes by pulling the grab loop away from him and up. The harness 10 has a hook 42 which fits over the elastic cord and is held by the same lip C as the spray skirt. The harness 10 is shown in more detail in FIGS. 2, 3, and 4. The harness 10 includes a back support 20, shown in FIG. 3, and a tether 40, shown in FIG. 4. The back support 20 has a torso band 22 made of strong, flexible strap of nylon webbing. The central portion 22*a* of the torso band 22 is longer and wider than the left 22*b* and right 22*c* ends. For example, the central portion 22*a* may be a twenty-four inch long by two inch wide length of webbing, to which nine inch long by one inch wide lengths are sewn to form the left 22*b* and right 22*c* sections, respectively. The left end 22*b* of the torso band 22 has a conventional strap buckle 24 fixedly attached to the torso band 22. A long tether attachment strap 26 of flexible nylon webbing is fixedly attached to the tether 40 at one end, as described below, and loops through the buckle 24 to provide size adjustment for the torso band 22.

The right end 22*c* of the torso band 22 has the female end of a quick release type buckle 28 fixedly attached to the torso band 22. The male end of the buckle 28 is attached to a tether attachment strap 30 of flexible nylon webbing having one end fixedly attached to the tether 40 as described below. The tether attachment strap 30 is slidably attached to the male end of the buckle 28, providing additional size adjustment for the torso band 22, the end of the strap 30 being doubled over to prevent its complete removal from the male end of the buckle 28. The buckles 24, 28 are preferably made from plastic for light weight. A Curved Mojave™ Standard Release buckle is an example of an acceptable conventional strap buckle 24. A Side Squeeze® buckle made by National Molding Corporation of Farmingdale, New York is an acceptable quick release buckle 28. Advantageously, the buckle 28 may be released by pressing the resilient side prongs of the male end of the buckle 28, even when the kayaker A is wearing gloves for protection from cold weather, and it may be released with one hand, if necessary. The right end 22*c* of the torso band 22 may have a patch of reflective material 31 sewn to the webbing to provide visibility in darkness or overcast weather.

A left 32 and right 34 shoulder strap are fixedly attached to the torso band near the center of the central portion 22*a*. The shoulder straps 32, 34 are joined by a short brace 36 parallel to and about five to six inches from the torso band 22. The shoulder straps 32, 34 and brace 36 are each made from 1½" wide flexible nylon webbing, the shoulder straps 32, 34 being about twenty inches long and the brace about six inches long. The right shoulder strap 34 and the brace may each have a patch of reflective material 31 sewn to the webbing. The left shoulder strap 32 terminates in a conventional strap buckle 33, similar to buckle 24, and the right shoulder strap terminates in the female portion of a quick release buckle 35, similar to buckle 28. Tether attachment straps 38, 39, made from flexible nylon webbing, are releasably attached to buckles 33, 35, strap 38 by looping through the buckle 33 in conventional fashion, and strap 39 by slidable attachment to the male end of buckle 35, the end of the strap 39 being double over to prevent complete disengagement from the male end of buckle 35. Thus, the length of shoulder straps 32 and 34 are adjustable. The opposite ends of tether attachment straps 38, 39 are fixedly attached to the tether as described below.

Figure 4:
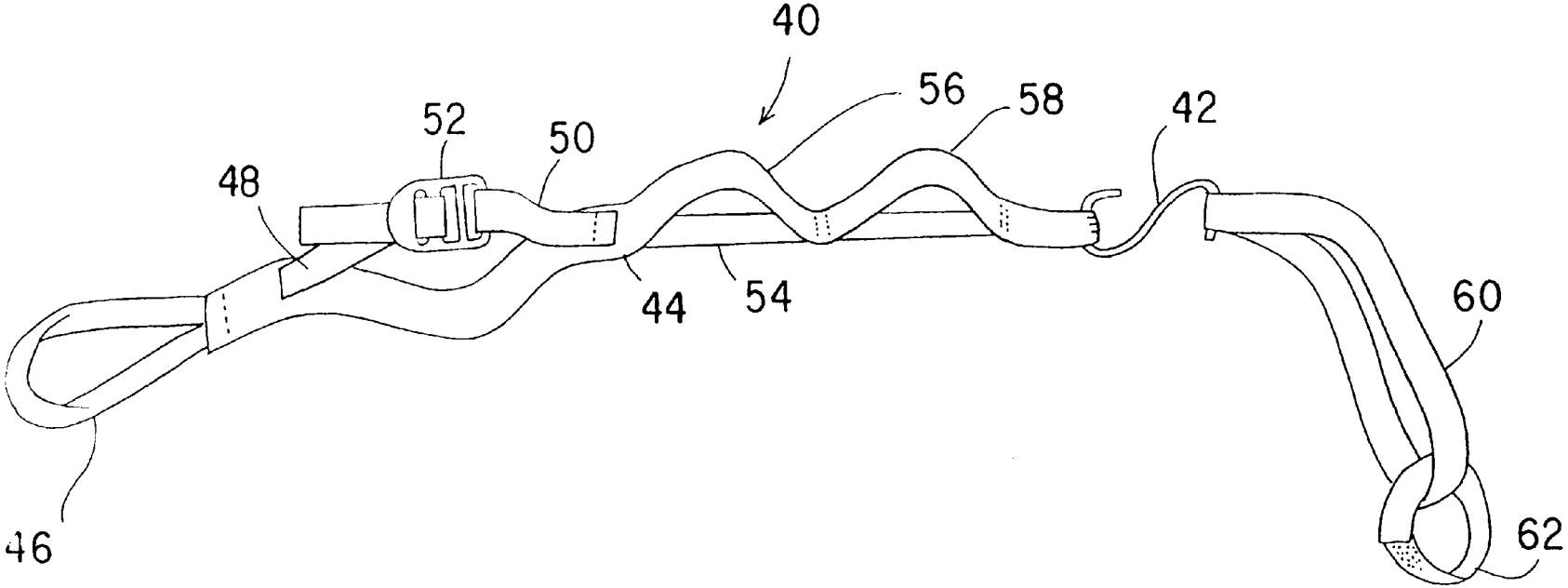
FIG. 4 is a front view of the tether of the kayaking harness according to the present invention, Similar reference characters denote corresponding features consistently throughout the attached drawings.

The tether 40 is shown more particularly in FIG. 4. The tether 40 includes a central strap 44 made from a flexible, strong nylon webbing. Representative dimensions of the central strap 44 may be eleven inches in length by two inches wide. The central strap 44 has an S-shaped hook 42 at one end, and a central loop 46 made from inch wide webbing fixedly attached to the other end. Tether attachment straps 26, 30, 38, and 39 are fixedly attached to the loop 46 by wrapping the end of the straps 26, 30, 38, and 39 around the loop 46 to form loops 47, which are secured by sewing. The length of the tether 40 is made adjustable over about a six inch range by sewing first 48 and second 50 length adjustment straps to the central strap 44, the length adjustment straps being adjustably joined by a conventional strap buckle 52, the length adjustment straps 48, 50 being parallel to the central strap 44, one of the straps 48, 50 being fixedly attached to the buckle 52, and the other being slidable and temporarily secured in the buckle 52, similar to buckles 24 and 33.

The length of the tether 40 is also resiliently biased by a length of elastic band 54 in parallel with a length of the central strap 44 longer than the elastic 54, the elastic 54 being sewn to the central strap 44 and in the middle to form two loops 56 and 58 in the central strap 44. A six inch wide linking loop 60 made from one inch wide nylon webbing is attached to the end of the hook opposite the central strap 44. A quick release loop 62 with a hook and loop fastening material on its surface is attached to the linking loop 60 for a purpose described below.

In use, the kayaker A places the spray skirt E around his waist and sits in the cockpit D of the kayak B, inserting the elastic cord of the spray skirt around the coaming C. The kayaker A then puts on the harness 10, the harness 10 fitting over any personal flotation devices (not shown in FIG. 1). The buckles 28 and 35 are snapped closed about the waist and right shoulder, respectively, the loop 46 being positioned about the front center of the torso, the brace 36 being positioned in the back of the torso. The length of the torso band 22 and shoulder straps 32 and 34 are adjusted accordingly. The hook 42 is placed over the lip on the coaming C, the tether 40 being outside the spray skirt E. The length of the tether 40 is adjusted for the kayaker's normal sitting position using length adjustment straps 48 and 50. The elastic band 54 maintains sufficient pull on the tether 40 so that hook 42 does not slip from the lip C when the kayaker A leans forward. The quick release loop 62 is attached to the grab loop F of the spray skirt E by a matching patch of hook and loop material sewn to the grab loop F.

No tension is placed on the hook and loop fastening material when the kayaker A leans back, the entire tension on the tether and back support being borne by the hook 42. During long tours or expeditions, the kayaker A may lean back to rest his back muscles, the harness 10 relieving the strain on his back muscles. In case of emergency, such as capsizing, the kayaker A may reach for the grab loop F of the spray skirt E, pulling it up and away to release the spray skirt E from the cockpit D as in a normal water exit, the harness 10 being released simultaneously due to the attachment of quick release loop 62 to the grab loop F. Once in the water, quick release buckles 28 and 35 may be released to completely remove the harness 10.

It is to be understood that the present invention is not limited to the embodiments described above, but encompasses any and all embodiments within the scope of the following claims. It will be apparent to those skilled in the art that the hook 42 may be either plastic or metal, and may be covered with soft rubber to provide a better grip on the coaming C. It will also be apparent that the harness may have padding and/or neoprene sewn to the inside of the shoulder straps 32, 34 and brace 36 for comfort.

I claim:

1. A kayaking harness for supporting the back of a kayaker, comprising:

a) a back support made from straps of strong nylon webbing adapted for wearing around the back and shoulders of a kayaker; and b) a tether attached to the back support, the tether having an S-shaped hook adapted for attachment to a coaming of a kayak and having a quick release loop attached to the hook, the quick release loop having hook and loop fastening material adapted for attachment to a grab loop of a spray skirt in order to release the harness from the kayak when said spray skirt is released.

2. The kayaking harness according to claim 1, wherein said tether further comprises:

a) a central strap made from strong, nylon webbing, said hook being attached to a first end of the central strap, the central strap having a second end;

b) a central loop for attachment to said back support, the central loop being attached to the second end of said central strap;

c) length adjustment means for adjusting the length of the tether when the kayaker is seated in a normal paddling position in the cockpit of a kayak; and d) resilient biasing means for maintaining sufficient tension on said tether to keep the hook attached to the coaming of a kayak when the kayaker leans forward.

3. The kayaking harness according to claim 2, wherein said length adjustment means comprises:

a) a first length adjustment strap having a first end and a second end, the first end being attached to said central strap;

b) a second length adjustment strap having a first end and a second end, the first end being attached to said central strap; and c) a strap buckle, the second end of said first length adjustment strap being fixedly attached to said strap buckle and the second end of said second length adjustment strap being slidable through said strap buckle and securable in said buckle, said first and second length adjustment straps being parallel to said central strap in order that the length of the tether may be adjusted by sliding and securing said second length adjustment strap in said strap buckle.

4. The kayaking harness according to claim 2, wherein said resilient biasing means comprises an elastic band having a first end, a second end, and a middle, the first and second ends of the elastic band being attached to the central strap to define a portion of the central strap, the elastic band being parallel to and shorter than the length of the portion of the central strap, a segment of the portion of the central strap between the first and second ends of the elastic band being fixedly attached to the middle of the elastic band to define a first loop and a second loop, so that the elastic band maintains tension on the hook when a kayaker leans forward.

5. The kayaking harness according to claim 1, wherein said back support further comprises:

a) a torso band having a central portion, a left end, and a right end;

b) a left shoulder strap fixedly attached to the central portion of said torso band;

c) a right shoulder strap fixedly attached to the central portion of said torso band;

d) a brace strap fixedly attached to said left and right shoulder straps parallel to said torso strap; and e) tether attachment means for attaching the left and right ends of said torso band and said left and right shoulder straps to said tether.

6. The kayaking harness according to claim 5, wherein said tether attachment means comprises:

a) a first tether attachment strap having a first end and a second end, the first end being fixedly attached to said tether, and the second end being slidably attached to a strap buckle, the strap buckle being fixedly attached to the left end of said torso band;

b) a second tether attachment strap having a first end and a second end, the first end being fixedly attached to said tether, and the second end being fixedly attached to a male end of a quick release buckle, a female end of the quick release buckle being slidably attached to the right end of said torso band;

c) a third tether attachment strap having a first end and a second end, the first end being fixedly attached to said tether, and the second end being slidably attached to a strap buckle, the strap buckle being fixedly attached to said left shoulder strap; and d) a fourth tether attachment strap having a first end and a second end, the first end being fixedly attached to said tether, and the second end being fixedly attached to a male end of a quick release buckle, a female end of the quick release buckle being slidably attached to said right shoulder strap.

7. The kayaking harness according to claim 6, wherein said strap buckles and said quick release buckles are made from a light weight plastic material.

* * * * *